US009181609B2

(12) United States Patent
Ishikawa et al.

(10) Patent No.: US 9,181,609 B2
(45) Date of Patent: Nov. 10, 2015

(54) WELDED STEEL PIPE FOR LINEPIPE HAVING HIGH COMPRESSIVE STRENGTH AND EXCELLENT SOUR GAS RESISTANCE AND MANUFACTURING METHOD THEREOF

(75) Inventors: Nobuyuki Ishikawa, Fukuyama (JP); Akihiko Tanizawa, Fukuyama (JP); Hitoshi Sueyoshi, Fukuyama (JP); Masayuki Horie, Fukuyama (JP); Yasumitsu Kiyoto, Fukuyama (JP); Nobuo Shikanai, Chiyoda-ku (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/511,790

(22) PCT Filed: Nov. 25, 2010

(86) PCT No.: PCT/JP2010/071536

§ 371 (c)(1),
(2), (4) Date: Aug. 20, 2012

(87) PCT Pub. No.: WO2011/065582

PCT Pub. Date: Jun. 3, 2011

(65) Prior Publication Data

US 2013/0000793 A1 Jan. 3, 2013

(30) Foreign Application Priority Data

Nov. 25, 2009 (JP) ..... 2009-267256

(51) Int. Cl.

| | |
|---|---|
| ***C22C 38/02*** | (2006.01) |
| ***B21C 37/08*** | (2006.01) |
| ***B21C 37/30*** | (2006.01) |
| ***C21D 1/20*** | (2006.01) |
| ***C21D 8/02*** | (2006.01) |
| ***C22C 38/00*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***F17D 1/16*** | (2006.01) |
| ***C21D 8/10*** | (2006.01) |
| ***C21D 9/50*** | (2006.01) |

(52) U.S. Cl.

CPC ..... *C22C 38/02* (2013.01); *B21C 37/08* (2013.01); *B21C 37/30* (2013.01); *C21D 1/20* (2013.01); *C21D 8/0226* (2013.01); *C21D 8/0263* (2013.01); *C22C 38/001* (2013.01); *C22C 38/002* (2013.01); *C22C 38/04* (2013.01); *C22C 38/06* (2013.01); *C22C 38/12* (2013.01); *C22C 38/14* (2013.01); *C22C 38/44* (2013.01); *C22C 38/46* (2013.01); *C22C 38/48* (2013.01); *C22C 38/50* (2013.01); *F17D 1/16* (2013.01); *C21D 8/10* (2013.01); *C21D 9/50* (2013.01); *C21D 2211/002* (2013.01); *C21D 2211/008* (2013.01)

(58) Field of Classification Search

CPC .... C22C 38/001; C22C 38/002; C22C 38/02; C22C 38/04; C22C 38/06; C22C 38/12; C22C 38/14; C22C 38/44; C22C 38/46; C22C 38/48; C22C 38/50; B21C 37/08; B21C 37/30; C21D 1/20; C21D 8/0026; C21D 8/0263; C21D 8/10; C21D 9/50; C21D 2211/002; C21D 2211/008; F17D 1/16

USPC ..... 148/332–336, 519, 521, 590; 420/84, 420/89–93, 104, 105, 108–112, 119, 123, 420/124, 126–129

See application file for complete search history.

(56) References Cited

FOREIGN PATENT DOCUMENTS

| | | | |
|---|---|---|---|
| EP | 1 662 014 | A1 | 5/2006 |
| EP | 1995339 | | 11/2008 |
| EP | 2224028 | | 9/2010 |
| EP | 2 505 681 | A1 | 10/2012 |
| EP | 2 505 682 | A1 | 10/2012 |
| EP | 2505683 | | 10/2012 |
| JP | 9-049025 | A | 2/1997 |
| JP | 2002-102931 | A | 4/2002 |
| JP | 2003-340518 | A | 12/2003 |
| JP | 2003-340519 | A | 12/2003 |
| JP | 2003-342639 | A | 12/2003 |
| JP | 2004-035925 | A | 2/2004 |
| JP | 2006-183133 | A | 7/2006 |

(Continued)

OTHER PUBLICATIONS

Shimamura et al., English machine translation of JP 2009-091653, Apr. 2009, p. 1-16.*

International Search Report dated Mar. 8, 2011, application No. PCT/JP2010/071536.

Supplementary European Search Report dated Mar. 13, 2013 (communicated on Apr. 5, 2013), application No. EP 10 83 3425.

Notice of Allowance mailed Mar. 30, 2015 in U.S. Appl. No. 13/511,826.

(Continued)

*Primary Examiner* — Roy King
*Assistant Examiner* — Caitlin Kiechle
(74) *Attorney, Agent, or Firm* — RatnerPrestia

(57) ABSTRACT

Provided is a steel pipe for a linepipe having high compressive strength, a heavy wall thickness and sour gas resistance. The steel pipe has the composition which contains by mass % 0.02 to 0.06% C, 0.01 to 0.5% Si, 0.8 to 1.6% Mn, 0.012% or less P, 0.0015% or less S, 0.01 to 0.08% Al, 0.005 to 0.050% Nb, 0.005 to 0.025% Ti, 0.0005 to 0.0035% Ca, 0.0020 to 0.0060% N, and Fe and unavoidable impurities as a balance. The steel pipe has metal microstructure where a fraction of bainite is 80% or more, a fraction of M-A constituent is 2% or less and an average grain size of bainite is 5 μm or less.

4 Claims, 3 Drawing Sheets

(56) References Cited

FOREIGN PATENT DOCUMENTS

| | | | | |
|---|---|---|---|---|
| JP | 2007-119884 | A | | 5/2007 |
| JP | 2008-056962 | A | | 3/2008 |
| JP | 2008-121036 | A | | 5/2008 |
| JP | 2009-052137 | A | | 3/2009 |
| JP | 2009052137 | | | 3/2009 |
| JP | 2009091653 | A | * | 4/2009 |
| JP | 2009-221534 | A | | 10/2009 |
| WO | WO 2009/061006 | A1 | | 5/2009 |

OTHER PUBLICATIONS

Final Office Action mailed May 18, 2015 in U.S. Appl. No. 13/511,822.

Entire patent prosecution history of U.S. Appl. No. 13/511,822, filed Aug. 10, 2012, entitled, "Welded Steel Pipe for Linepipe Having High Compressive Strength and High Fracture Toughness and Manufacturing Method Thereof.".

Entire patent prosecution history of U.S. Appl. No. 13/511,826, filed Aug. 3, 2012, entitled, "Welded Steel Pipe for Linepipe With High Compressive Strength and Manufacturing Method Thereof.".

International Search Report dated Mar. 8, 2011, application No. PCT/JP2010/071528.

International Search Report dated Mar. 8, 2011, application No. PCT/JP2010/071527.

Machine-English translation of Japanese patent 2009-052137, Ishikawa Nobuyuki et al., Mar. 12, 2009.

Supplemental European Search Report dated Mar. 19, 2013, application No. EP10833422.

Supplementary European Search report dated Mar. 26, 2013, application No. EP10833421.

* cited by examiner

WELDED STEEL PIPE FOR LINEPIPE HAVING HIGH COMPRESSIVE STRENGTH AND EXCELLENT SOUR GAS RESISTANCE AND MANUFACTURING METHOD THEREOF

CROSS-REFERENCE TO RELATED APPLICATIONS

This application is the U.S. National Phase application of PCT International Application No. PCT/JP2010/071536, filed Nov. 25, 2010, and claims priority to Japanese Patent Application No. 2009-267256, filed Nov. 25, 2009, the disclosures of which PCT and priority applications are incorporated herein by reference in their entireties for all purposes.

FIELD OF THE INVENTION

The present invention relates to a linepipe having excellent sour gas resistance for transporting crude oil, natural gas or the like, and more particularly to a welded steel pipe for a linepipe having high compressive strength and excellent sour gas resistance suitably used as a linepipe for deep-sea having a heavy wall thickness to exhibit high collapse resistant performance, and a manufacturing method thereof. The compressive strength used in the present invention means, unless otherwise specified, compressive yield strength or 0.5% compressive proof strength. Also, the tensile yield strength means, unless otherwise specified, tensile yield strength or 0.5% tensile proof strength, wherein tensile strength means maximum stress obtained in a tensile test as usually defined.

BACKGROUND OF THE INVENTION

Along with the increase in demand for energy in recent years, the development of pipelines for crude oil or natural gas has been promoted, and various pipelines which are constructed in oceans have been also developed to cope with a situation where gas fields or oil fields are located at remoter places or versatility in transport routes. To prevent a linepipe used for an offshore pipeline from collapsing due to water pressure, the linepipe for an offshore pipeline is formed of a linepipe having a wall thickness larger than a wall thickness of a linepipe for an onshore pipeline. Further, the linepipe used for offshore pipeline is required to exhibit high roundness. With respect to material quality of the linepipe, the linepipe is required to possess high compressive strength to cope with compression stress generated in the circumferential direction of the pipe by external pressure.

It is often the case where the DNV standard (Det Norske Veritas standard) (OSF-101) is adopted in designing offshore pipelines. In this standard, collapse pressure is obtained using, as factors for deciding collapse pressure due to external pressure, a pipe diameter D, a wall thickness t, the roundness $f_0$ of a pipe and tensile yield strength fy of a material. However, the compressive strength changes depending on a manufacturing method of pipes even when pipes have the same size and the same tensile strength and hence, tensile yield strength is multiplied by a coefficient ($\alpha$fab) which differs depending on the manufacturing method. In the case of a seamless pipe, this DNV standard coefficient is 1.0, that is, tensile yield strength can be directly applied. However, in the case of a pipe manufactured by a UOE forming process, 0.85 is given as the coefficient. This is because, in the case of a pipe manufactured by a UOE forming process, compressive strength becomes lower than tensile yield strength. To consider a factor which causes such lowering of compressive strength, a UOE steel pipe is subjected to a pipe expanding process in a final step of pipe making so that the UOE steel pipe receives compression after tensile deformation is imparted to the pipe in the circumferential direction of the pipe whereby the compressive strength is lowered by a Bauschinger effect. Accordingly, it is necessary to increase compressive strength of the pipe for increasing collapse resistant performance. However, in the case of a steel pipe which is manufactured through a pipe expanding process in cold forming, there exists a drawback that compressive yield strength is lowered by a Bauschinger effect.

Many studies have been made with respect to the enhancement of collapse resistant performance of a UOE steel pipe, and patent document 1 discloses a method where a steel pipe is heated by Joule heating and, after the steel pipe is expanded, a temperature is held for a fixed time or more. According to this method, dislocation brought about by the pipe expansion is eliminated or dispersed and hence, the steel pipe can acquire a high yield point. However, it is necessary to continue Joule heating for holding the temperature for 5 minutes or more after the pipe expansion and hence, productivity is deteriorated.

Further, in the same manner as patent document 1, as a method of recovering compressive yield strength lowered by a Bauschinger effect by heating the steel pipe after pipe expansion, patent document 2 proposes a method where an outer surface of a steel pipe is heated to a temperature higher than a temperature of an inner surface of the steel pipe so that compressive yield strength on an inner surface side increased by strain hardening is maintained, and compressive yield strength on an outer surface side lowered by a Bauschinger effect is increased.

Further, patent document 3 proposes a method where accelerated cooling is performed from an $Ar_3$ temperature or above to 300° C. or below after hot rolling in a process of manufacturing a steel plate made of Nb—Ti added steel, a steel pipe is made from the steel plate by a UOE forming process and, thereafter, the steel pipe is heated at a temperature of 80 to 550° C.

However, with respect to the method disclosed in patent document 2, it is extremely difficult to separately control the heating temperature and the heating time of the outer surface and the inner surface of the steel pipe in terms of the actual manufacture of a steel pipe, and particularly to control quality of the steel pipe in a mass production process is extremely difficult. The method disclosed in patent document 3 also has a drawback that it is necessary to set a stop temperature of accelerated cooling in the manufacture of the steel plate at the low temperature of 300° C. or below and hence, the distortion of the steel plate is increased whereby when a steel pipe is made from the steel plate by a UOE forming process, roundness of the steel pipe is lowered. The method disclosed in patent document 3 further has a drawback that since the accelerated cooling is performed from the $Ar_3$ temperature or above, it is necessary to perform rolling at a relatively high temperature so that fracture toughness is deteriorated.

On the other hand, as a method of increasing compressive strength by a steel pipe forming method without performing heating after pipe expansion, patent document 4 discloses a method where a compression rate at the time of O shape forming is set larger than an expansion rate in the steel expansion performed after the O shape forming. According to the method disclosed in patent document 4, there is substantially no tensile pre-strain in the circumferential direction of a steel pipe and hence, a Bauschinger effect does not occur whereby the steel pipe can acquire high compressive strength. However, when the expansion rate is low, it becomes difficult for the steel pipe to maintain roundness thus giving rise to a possibility that collapse resistant performance of the steel pipe is deteriorated.

Patent document 5 discloses a method where collapse resistant performance is enhanced by making a diameter of a steel pipe where a seam weld and an axially symmetric part of the seam weld (a position 180° away from the seam weld, and a portion where compressive strength on an outer surface side is low) are set as end points become the maximum diameter of the steel pipe. However, a portion of the steel pipe which may cause a problem on collapse in the actual pipeline construction is a portion of the steel pipe which reaches a sea bed and is subjected to bending deformation (sag-bend portion), and the pipeline is constructed on the sea bed by girth weld irrelevant to the position of the seam weld of the steel pipe. Accordingly, even when the end point to the seam weld is set on a major axis, the method does not exhibit any practical effects.

Further, patent document 6 proposes a steel plate where reheating is performed after accelerated cooling so that a fraction of a hard second phase in a steel plate surface layer portion is decreased, and the difference in hardness between the surface layer portion and the plate thickness center portion is made small and hence, the uniform strength distribution in the plate thickness direction is acquired whereby lowering of yield stress caused by a Bauschinger effect can be made small.

Further, patent document 7 proposes a manufacturing method of a steel plate for a linepipe having high strength and sour gas resistance with a plate thickness of 30 mm or more, wherein in reheating treatment after accelerated cooling, a steel plate surface layer portion is heated while suppressing the elevation of a temperature of a steel plate center portion. Due to such a manufacturing method, a fraction of a hard second phase of a steel plate surface layer portion can be decreased while suppressing lowering of DWTT property (Drop Weight Tear Test property) and hence, a steel plate where hardness of the steel plate surface layer portion is decreased and has small irregularities in material quality is acquired, and also the reduction of a Bauschinger effect due to the decrease of the fraction of the hard second phase can be also expected.

However, in the technique described in patent document 6, it is necessary to perform heating such that heating reaches a center portion of the steel plate at the time of reheating thus causing lowering of DWTT property. Accordingly, the application of the technique to a linepipe having a heavy wall thickness for deep sea has been difficult.

Further, a Bauschinger effect is influenced by various microstructure factors such as a grain size or an amount of solid solute carbon and hence, a steel pipe having high compressive strength cannot be acquired with the mere reduction of a hard second phase as in the case of a technique described in patent document 7. Further, under the reheating condition disclosed in patent document 7, it is difficult for the steel pipe to acquire a balance among excellent tensile strength, excellent compressive strength and excellent DWTT property due to coarsening of cementite through coagulation, precipitation of a carbide forming element such as Nb or C and the lowering of solid solute C caused by the coarsening of cementite and the precipitation of the carbide forming element.

Patent document 1 JP-A-9-49025
Patent document 2 JP-A-2003-342639
Patent document 3 JP-A-2004-35925
Patent document 4 JP-A-2002-102931
Patent document 5 JP-A-2003-340519
Patent document 6 JP-A-2008-56962
Patent document 7 JP-A-2009-52137

SUMMARY OF THE INVENTION

Embodiments of the present invention have been made under the above-mentioned circumstances, and it is an object of the present invention to provide a welded steel pipe for a linepipe having a heavy wall thickness and having high strength and excellent fracture toughness necessary for the application of the steel pipe to a sea bed pipeline, that is, for a linepipe having a heavy wall thickness, having high compressive strength by suppressing lowering of compressive strength caused by a Bauschinger effect by optimizing the metal microstructure of a steel plate, and exhibiting excellent sour gas resistance without requiring particular forming conditions in forming the steel pipe and without requiring heat treatment after pipe making.

Inventors of the present invention have carried out a cyclic loading test where a pipe making step is simulated using steel plates having various microstructures in order to clarify the relationship between compressive strength of a steel pipe manufactured by cold forming and the microstructure of a steel material. Steel plates having a plate thickness of 38 mm which differ in microstructure were manufactured using steel containing, as main components, 0.04% C, 0.3% Si, 1.2% Mn, 0.28% Ni, 0.12% Mo and 0.04% Nb.

FIG. 1 shows the microstructures of three kinds of steel plates (optical microscope photographs). The steel plates 1 and 2 have the microstructure which is mainly constituted of bainite (also referred to as "bainitic ferrite"), while the steel plate 3 has the microstructure which is constituted of granular ferrite (also referred to as "polygonal ferrite") and bainite.

FIG. 2 shows scanning electron microscope (SEM) photographs of the steel plates 1 and 2. The steel plate 1 has the microstructure which is mainly constituted of bainite, and a second phase (M-A constituent (also referred to as "MA") or cementite) is slightly observed in a bainite grain boundary, while the steel plate 2 has a large number of M-A constituents (MA) which are observed in the steel plate 2 as indicated by an arrow in the photograph. Round bar tensile specimens were sampled from these steel plates in the direction perpendicular to the rolling direction at a position of ¼ of a plate thickness corresponding to an inner surface side of a steel pipe. Then, the deformation of compression (strain of 0 to 3%)→4 tension (strain of 2%) which simulates the deformation of an inner surface of the steel pipe was applied to the specimens and, thereafter, a compression test was carried out so as to obtain compressive strengths of the specimens.

FIG. 3 shows the relationship between compression strain applied first and compressive yield strength (compression YS) obtained by the final compressive test. In all steel plates, the larger the compression strain applied first is, the higher the compressive strength obtained by the final compressive test becomes, wherein the steel plate 1 exhibits the highest compressive strength. That is, it is reasonable to say that lowering of compressive strength caused by a Bauschinger effect generated at the time of reversing a load in cyclic loading is small in the steel plate 1. It is thought that the steel plate 1 has the uniform bainite microstructure which hardly contains a second phase such as polygonal ferrite or MA, a grain size of bainite is small, and a second phase such as cementite observed in a trace amount is formed in a bainite grain boundary and hence, the integration of local dislocation in the inside of the microstructure is suppressed whereby the generation of back stress which causes a Bauschinger effect is suppressed. The inventors of the present invention have carried out various experiments to achieve a steel pipe which satisfies both the enhancement of compressive strength which is suppressed by a Bauschinger effect and the acquisition of strength, toughness and sour gas resistance, and have made the following findings.

1) Lowering of compressive strength due to a Bauschinger effect is caused by the generation of back stress due to the integration of dislocation in an interface between different phases or in a hard second phase. To prevent the lowering of compressive strength caused by a Bauschinger effect, firstly, it is effective to decrease a ferrite-bainite interface and the hard second phase such as M-A constituent (MA) which are places where dislocation is integrated. For this end, in the metal microstructure, fractions of the soft ferrite phase and the hard MA are decreased thus forming the metal microstructure into the microstructure mainly constituted of bainite whereby lowering of compressive strength caused by a Bauschinger effect can be suppressed.

2) High-strength steel manufactured by accelerated cooling, particularly a steel plate having a heavy wall thickness used for a sea-bed pipeline contains a large amount of alloy elements for acquiring required strength so that the steel plate has high hardenability whereby it is difficult to completely suppress the formation of MA. However, by making the bainite microstructure fine, by finely dispersing formed MA and by decomposing MA into cementite by reheating or the like after accelerated cooling, a Bauschinger effect due to the second phase can be decreased.

3) By properly setting a C content and an addition content of carbide formation element such as Nb in the steel material thus sufficiently ensuring solid solute C, an interaction between dislocation and solid solute C is enhanced whereby the movement of dislocation at the time of inversion of a load is impeded so that lowering of compressive strength due to back stress can be suppressed.

4) Since addition contents of alloy elements are large in high-strength steel having a heavy wall thickness, hardness of a center segregation portion becomes also high and hence, HIC resistance (Hydrogen Induced Cracking resistance) is deteriorated. To prevent the deterioration of HIC resistance, it is preferable to selectively add alloy elements such that the hardness of the center segregation portion does not exceed a fixed level by taking the behavior of incrassate of alloy elements toward the center segregation portion into consideration.

Embodiments of the present invention have been made based on such findings.

The first embodiment is directed to a welded steel pipe for a linepipe having high compressive strength and exhibiting excellent sour gas resistance, the steel pipe having the composition which contains by mass % 0.02 to 0.06% C, 0.01 to 0.5% Si, 0.8 to 1.6% Mn, 0.012% or less P, 0.0015% or less S, 0.01 to 0.08% Al, 0.005 to 0.050% Nb, 0.005 to 0.025% Ti, 0.0005 to 0.0035% Ca, 0.0020 to 0.0060% N, and Fe and unavoidable impurities as a balance, wherein C(%)−0.065Nb(%) is 0.025 or more, a CP value expressed by a following formula is 0.95 or less, a Ceq value expressed by a following formula is 0.28 or more, Ti/N is a value which falls within a range of 1.5 to 4.0, and the steel pipe has metal microstructure where a fraction of bainite is 80% or more, a fraction of M-A constituent (MA) is 2% or less, and an average grain size of bainite is 5 μm or less.

$$CP=4.46C(\%)+2.37Mn(\%)/6+\{1.18Cr(\%)+1.95Mo(\%)+1.74V(\%)\}/5+\{1.74Cu(\%)+1.7Ni(\%)\}/15+22.36P(\%)$$

$$Ceq=C(\%)+Mn(\%)/6+\{Cr(\%)+Mo(\%)+V(\%)\}/5+\{Cu(\%)+Ni(\%)\}/15$$

According to the second embodiment, in the welded steel pipe for a linepipe having high compressive strength and exhibiting excellent sour gas resistance according to the first embodiment, the composition further contains by mass % one or two kinds or more selected from a group consisting of 0.5% or less Cu, 1.0% or less Ni, 0.5% or less Cr, 0.5% or less Mo, and 0.1% or less V, and C(%)−0.065Nb(%)−0.025Mo(%)−0.057V(%) is 0.025 or more.

The third embodiment is directed to a method of manufacturing a welded steel pipe for a linepipe having high compressive strength and exhibiting excellent sour gas resistance, wherein steel having the composition described in the first embodiment or the second embodiment is heated to a temperature which falls within a range of 950 to 1200° C., is subjected to hot rolling where a rolling reduction rate in a no-recrystallization temperature range is set to 60% or more and a rolling completion temperature falls within a range of $Ar_3$ to ($Ar_3$+70° C.), and subsequently, is subjected to accelerated cooling at a cooling rate of 10° C./sec or more from a temperature of ($Ar_3$-30° C.) or more to a temperature which falls within a range of 300° C. or above to 550° C. thus a steel plate being manufactured, the steel plate is formed into a steel pipe shape by cold forming, seam welding is applied to a butt portion of the steel pipe shape to form a steel pipe, and the steel pipe is subjected to pipe expansion with an expansion rate of 0.4 to 1.2%.

According to the fourth embodiment, in the method of manufacturing a welded steel pipe for a linepipe having high compressive strength and exhibiting excellent sour gas resistance according to the third embodiment, the steel plate is subjected to reheating following the accelerated cooling such that a steel plate surface temperature falls within a range of 550° C. to 720° C., and a steel plate center temperature becomes below 550° C.

According to embodiments of the present invention, it is possible to acquire a steel pipe for a linepipe having high strength, excellent toughness, high compressive strength and further excellent sour gas resistance necessary for the application of the steel pipe to a sea-bed pipeline.

DETAILED DESCRIPTION OF THE INVENTION

Figure 1:
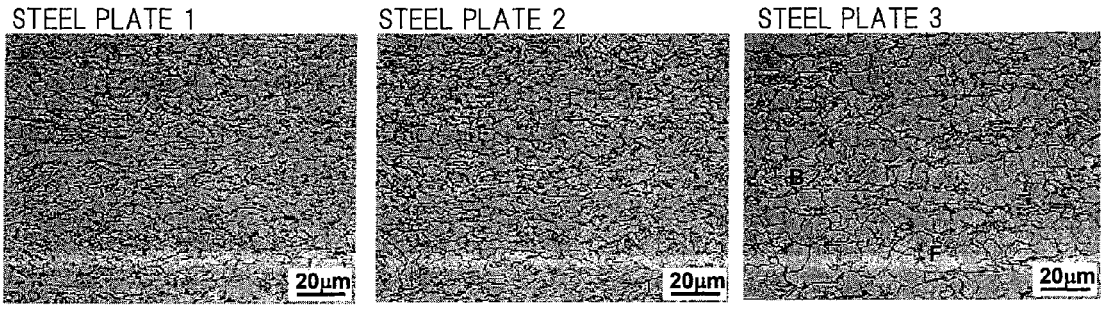
FIG. 1 is a view showing the microstructures of three kinds of steel plates (optical microphotograph).
Figure 2:
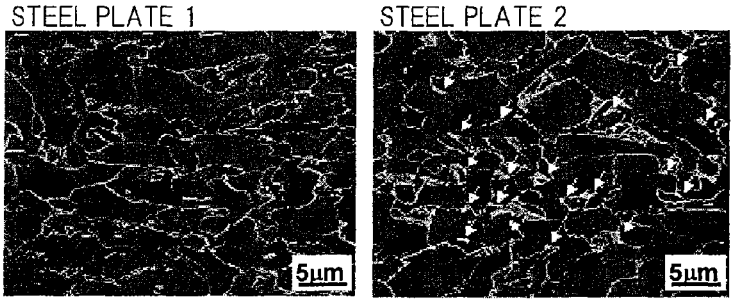
FIG. 2 is a view showing the microstructure of steel plates 1 and 2 using scanning electron microscope (SEM) photographs.
Figure 3:
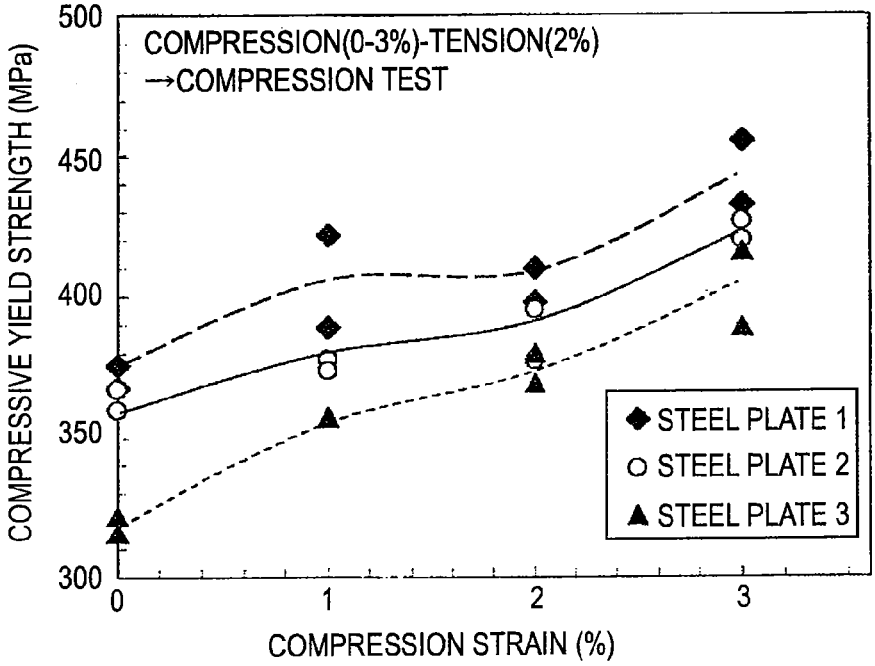
FIG. 3 is a view showing the relationship between firstly applied compression strain and compressive strength (compression YS) obtained by a final compressive test.

The mode for carrying out embodiments of the present invention is explained hereinafter.

Firstly, reasons for limiting the respective constitutional elements of embodiments of the present invention are explained.

1. Chemical Composition

Firstly, the reasons for limiting chemical contents contained in a high-strength high-toughness steel plate of embodiments of the present invention are explained. In all components, component % means mass %. In embodiments of the present invention, a next digit to a numerical value constituting a numerical value range of each chemical composition or the like defined hereinafter is 0. For example, 0.02 to 0.06% C means 0.020 to 0.060% C, and 0.01 to 0.5% Si means 0.010 to 0.50% Si. Further, also with respect to a grain size, 5 μm or less means 5.0 μm or less. Further, a fraction of MA or the like of 2% or less means a fraction of MA or the like of 2.0% or less.

C: 0.02 to 0.06%

C is the most effective element for increasing tensile strength of a steel plate which is manufactured by accelerated cooling. However, when the content of C is less than 0.02%, the steel plate cannot ensure sufficient strength, while when the content of C exceeds 0.06%, fracture toughness and HIC resistance are deteriorated. Accordingly, the content of C is set to a value which falls within a range of 0.02 to 0.06%. The content of C is more preferably set to a value which falls within a range of 0.030 to 0.060%.

Si: 0.01 to 0.5%

Si is added to the steel for deoxidation. Such an effect can be acquired when the content of Si is 0.01% or more. On the other hand, when the content of Si exceeds 0.5%, fracture toughness and weldability are deteriorated. Accordingly, the content of Si is set to a value which falls within a range of 0.01 to 0.5%. The content of Si is more preferably set to a value which falls within a range of 0.01 to 0.35%.

Mn: 0.8 to 1.6%

Mn is added to the steel for enhancing tensile strength, compressive strength and fracture toughness of steel. When the content of Mn is less than 0.8%, such effects are not sufficient, while when the content of Mn exceeds 1.6%, weldability and HIC resistance of the steel plate are deteriorated. Accordingly, the content of Mn is set to a value which falls within a range of 0.8 to 1.6%. The content of Mn is more preferably set to a value which falls within a range of 1.10 to 1.50%.

P: 0.012% or Less

P is an unavoidable impurity element, and increases hardness of a center segregation portion thus deteriorating HIC resistance. Such tendency becomes conspicuous when the content of P exceeds 0.012%. Accordingly, the content of P is set to 0.012% or less. The content of P is preferably set to 0.008% or less.

S: 0.0015% or Less

S is an unavoidable impurity element. Although S constitutes an MnS-based inclusion in steel in general, the MnS-based inclusion is turned into a shape-controlled CaS-based inclusion due to the addition of Ca. However, when the content of S is high, the amount of the CaS-based inclusion also becomes large so that the CaS-based inclusions may become initiation points of cracks in a high-strength material. Such tendency becomes conspicuous when the content of S exceeds 0.0015%. Accordingly, the content of S is set to 0.0015% or less. When the steel is required to exhibit the higher HIC resistance, it is effective to further lower the content of S, and the content of S is preferably set to 0.0008% or less.

Al: 0.01 to 0.08%

Al is added to the steel as a deoxidizer. The steel can acquire such an effect when the content of Al is 0.010% or more. However, when the content of Al exceeds 0.08%, cleanliness is lowered thus deteriorating ductility. Accordingly, the content of Al is set to a value which falls within a range of 0.01 to 0.08%. The content of Al is more preferably set to a value which falls within a range of 0.010 to 0.040%.

Nb: 0.005 to 0.050%

Nb enhances fracture toughness by refining the microstructure of steel caused by suppressing grain growth during rolling. However, when the content of Nb is less than 0.005%, steel cannot acquire this effect. On the other hand, when the content of Nb exceeds 0.050%, C precipitates in the form of carbide and hence, the content of solid solute C is lowered whereby a Bauschinger effect is accelerated so that high compressive strength cannot be acquired. Further, coarse non solid solute NbC is generated in a center segregation portion thus deteriorating HIC resistance. Accordingly, the content of Nb is set to a value which falls within a range of 0.005 to 0.050%. When the steel is required to exhibit the higher HIC resistance, the content of Nb is desirably set to a value which falls within a range of 0.005 to 0.035%.

Ti: 0.005 to 0.025%

Ti forms TiN and suppresses the grain growth during heating a slab and also suppresses a grain growth of a welded heat affected zone thus enhancing fracture toughness by refining the microstructure of a base material and the welded heat affected zone. However, when the content of Ti is less than 0.005%, such effects cannot be acquired, while when the content of Ti exceeds 0.025%, the fracture toughness is deteriorated. Accordingly, the content of Ti is set to a value which falls within a range of 0.005 to 0.025%. The content of Ti is more preferably set to a value which falls within a range of 0.005 to 0.020%.

Ca: 0.0005 to 0.0035%

Ca is an element effective for enhancing ductility by controlling the shape of sulfide-based inclusions. However, when the content of Ca is less than 0.0005%, such an effect cannot be acquired. On the other hand, even when the content of Cal added exceeds 0.0035%, the effect is saturated and, rather, fracture toughness is deteriorated due to lowering of cleanliness. Accordingly, the content of Ca is set to a value which falls within a range of 0.0005 to 0.0035%. The content of Ca is more preferably set to a value which falls within a range of 0.0015 to 0.0035%.

N: 0.0020 to 0.0060%

Nitrogen is contained in steel as an impurity. When N is present in steel as a solid solute element in the same manner as C, N accelerates strain aging and contributes to prevention of lowering of compressive strength caused by a Bauschinger effect. However, when the content of N is less than 0.0020%, such an effect is small, while when the content of N exceeds 0.0060%, fracture toughness is deteriorated. Accordingly, the content of N is set to a value which falls within a range of 0.0020 to 0.0060%. The content of N is more preferably set to a value which falls within a range of 0.0020 to 0.0050%.

C(%)−0.065Nb(%): 0.025 or More

Embodiments of the present invention aims at the enhancement of compressive strength of a steel pipe by reducing a Bauschinger effect through the suppression of the generation of back stress by making use of an interaction between solid solute C and dislocation and hence, it is important for the steel pipe to ensure effective solid solute C. In general, C in steel precipitates in the form of cementite or MA, and also is bonded with a carbide forming element such as Nb and precipitates in the form of carbide thus reducing an amount of solid solute C. Here, when the content of Nb is excessively large relative to the content of C, a precipitation amount of Nb carbide becomes large and hence, a sufficient amount of solid solute C cannot be obtained. However, when C(%)−0.065Nb (%) is 0.025 or more, a sufficient amount of solid solute C can be obtained. Accordingly, C(%)−0.065Nb(%) which is the relationship formula between the content of C and the content of Nb is set to 0.025 or more. C(%)−0.065Nb(%) is more preferably set to 0.028 or more.

C(%)−0.065Nb(%)−0.025Mo(%)−0.057V(%): 0.025 or More

Mo and V, which are selective elements of embodiments of the present invention are elements which form carbide in the same manner as Nb and hence, it is also preferred to add these elements to the steel within ranges to an extent that a sufficient amount of solid solute C can be obtained. However, when a value of the relational formula expressed by C(%)−0.065Nb(%)−0.025Mo(%)−0.057V(%) is less than 0.025, an amount of solid solute C becomes short and hence, C(%)−0.065Nb(%)−0.025Mo(%)−0.057V(%) is set to 0.025 or more. C(%)−0.065Nb(%)−0.025Mo(%)−0.057V(%) is more preferably set to 0.028 or more. With respect to the element whose content is at an unavoidable impurity level (element not added), the calculation is made by setting the content of the element to 0%.

Ti/N: 1.5 to 4.0

N in steel is bonded with Ti and forms nitride and hence, an amount of solid solute N changes corresponding to the relationship with an addition amount of Ti. When Ti/N which is a ratio of the content of Ti by mass % to the content of N by mass % exceeds 4.0, most of N in the steel is formed into Ti nitride so that an amount of solid solute N becomes short, while when Ti/N is less than 1.5, an amount of solid solute N is becomes relatively too large so that fracture toughness is deteriorated. Accordingly, Ti/N is set to a value which falls within a range of 1.5 to 4.0. Ti/N is more preferably set to a value which falls within a range of 1.50 to 3.50.

In embodiments of the present invention, in addition to the above-mentioned chemical components, the following elements can be added as selective elements.

Cu: 0.5% or Less

Although Cu is not necessarily added to the steel, Cu is an element effective for improving fracture toughness and for increasing tensile strength and compressive strength. To acquire such effects, it is preferable to set the content of Cu added to 0.10% or more. However, when the content of Cu added exceeds 0.5%, weldability is deteriorated. Accordingly, when Cu is added to the steel, the content of Cu added is set to 0.5% or less. The content of Cu added is more preferably set to 0.40% or less.

Ni: 1.0% or Less

Although Ni is not necessarily added to the steel, Ni is an element effective for improving fracture toughness and for increasing tensile strength and compressive strength. To acquire such effects, it is preferable to set the content of Ni added to 0.10% or more. However, when the content of Ni added exceeds 1.0%, weldability is deteriorated thus accelerating the occurrence of cracks on a surface of a slab at the time of continuous casting. Accordingly, when Ni is added to the steel, the content of Ni added is set to 1.0% or less. The content of Ni added is more preferably set to 0.80% or less.

Cr: 0.5% or Less

Although Cr is not necessarily added to the steel, Cr is an element effective for improving fracture toughness and for increasing tensile strength and compressive strength. To acquire such effects, it is preferable to set the content of Cr added to 0.10% or more. However, when the content of Cr to added exceeds 0.5%, weldability is deteriorated. Accordingly, when Cr is added to the steel, the content of Cr added is set to 0.5% or less. The content of Cr added is more preferably set to 0.30% or less.

Mo: 0.5% or Less

Although Mo is not necessarily added to the steel, Mo is an element effective for improving fracture toughness and for increasing tensile strength and compressive strength. To acquire such effects, it is preferable to set the content of Mo added to 0.05% or more. However, when the content of Mo added exceeds 0.5%, weldability is deteriorated. Accordingly, when Mo is added to the steel, the content of Mo added is set to 0.5% or less. The content of Mo added is more preferably set to 0.30% or less.

V: 0.1% or Less

Although V is not necessarily added to the steel, V is an element effective for improving fracture toughness and for increasing tensile strength and compressive strength. To acquire such effects, it is preferable to set the content of V added to 0.010% or more. However, when the content of V added exceeds 0.1%, in the same manner as Nb, V precipitates as carbide thus decreasing solid solute C. Accordingly, when V is added to the steel, the content of V added is set to 0.1% or less. The content of V added is more preferably set to 0.060% or less.

CP Value Expressed by Following Formula: 0.95 or Less $$CP=4.46C(\%)+2.37Mn(\%)/6+\{1.18Cr(\%)+1.95Mo(\%)+1.74V(\%)\}/5+\{1.74Cu(\%)+1.7Ni(\%)\}/15+22.36P(\%)$$

CP is a formula which is created for estimating material quality of a center segregation portion based on contents of respective alloy elements, and the higher the value of CP, the concentration of the center segregation portion becomes high so that the hardness of the center segregation portion is elevated. By setting this CP value to 0.95 or less, the hardness of the center segregation portion can be lowered so that the occurrence of cracks in an HIC test can be suppressed. The lower the value of CP is, the lower the hardness of the center segregation portion becomes and hence, when the further higher HIC resistance is necessary, it is desirable to set an upper limit of the CP value to 0.92. With respect to the element whose content is at an unavoidable impurity level (element not added), the calculation is made by setting the content of the element to 0%.

Ceq Value: 0.28 or More $$Ceq=C(\%)+Mn(\%)/6+\{Cr(\%)+Mo(\%)+V(\%)\}/5+\{Cu(\%)+Ni(\%)\}/15$$

Ceq is a hardenability index of steel. The higher the Ceq value is, the higher the tensile strength and the compressive strength of a steel material become. When the Ceq value is less than 0.28, a steel pipe having a heavy wall thickness exceeding 20 mm cannot ensure sufficient strength and hence, the Ceq value is set to 0.28 or more. The Ceq value is more preferably set to a value which falls within a range of 0.28 to 0.38. Further, to ensure sufficient strength with respect to a steel pipe having a thickness exceeding 30 mm, the Ceq value is desirably set to 0.36 or more. The higher the Ceq value is, the low-temperature crack sensitivity is increased, and thus weld cracks are promoted. Accordingly, to allow welding of a steel material without preheating even under a severe environment such as an environment on a pipeline construction ship, an upper limit of the Ceq value is set to 0.42. With respect to the element whose content is at an unavoidable impurity level (element not added), the calculation is made by setting the content of the element to 0%.

Although a balance of steel of embodiments of the present invention is constituted of Fe and unavoidable impurities, the steel may contain other elements and unavoidable impurities other than the above-mentioned elements provided that the other elements and the impurities do not impair the advantageous effects of the present invention.

2. Metal Microstructure

Reasons for limiting metal microstructure in embodiments of the present invention are explained hereinafter.

Fraction of Bainite: 80% or More

To acquire high compressive strength by suppressing a Bauschinger effect, it is preferable to form the metal microstructure into the uniform microstructure having a small amount of soft ferrite phase and a small amount of hard second phase thus suppressing the integration of local dislocation generated in the inside of the microstructure at the time of deformation. Accordingly, the metal microstructure is mainly formed of bainite. To acquire such an effect, it is preferable to set a fraction of bainite to 80% or more. Further, when higher compressive strength is required, it is desirable to set the fraction of bainite to 90% or more.

Fraction of M-A Constituent (MA): 2% or Less

M-A constituent (MA) is an extremely hard phase, and accelerates the integration of local dislocation at the time of deformation to bring about lowering of compressive strength caused by a Bauschinger effect. Thus, it is preferable to strictly limit a fraction of M-A constituent. However, when the fraction of MA is 2% or less, the influence exerted by M-A constituent is small and hence, lowering of compressive strength does not occur. Accordingly, the fraction of M-A constituent (MA) is set to 2% or less.

As for the metal microstructure of embodiments of the present invention, predetermined properties can be acquired by setting the fraction of bainite to 80% or more and the fraction of MA to 2% or less as described above, which may further contain other metal microstructure such as ferrite, cementite or pearlite. However, to suppress a Bauschinger effect, a fraction of ferrite is preferably set to less than 20%, and fractions of metal microstructures such as cementite and pearlite other than bainite, MA and ferrite are preferably set to 5% or less in total.

Average Grain Size of Bainite: 5 μm or Less

In a high-strength steel plate having a heavy wall thickness, it is difficult to completely suppress the formation of a hard phase such as MA. However, the formed MA and cementite can be finely dispersed by refining the bainite microstructure so that the integration of local dislocation at the time of deformation can be alleviated leading to the reduction of a Bauschinger effect. Further, a bainite grain boundary also becomes a location where the dislocation is integrated and hence, with the increase of an area of the grain boundary brought about by refining the microstructure, the integration of local dislocation in the grain boundary can be alleviated thus eventually enhancing the compressive strength by reducing a Bauschinger effect. Further, the fine microstructure is also effective for allowing a material having a heavy wall thickness to acquire sufficient base-material fracture toughness. Such effects can be acquired by setting the average grain size of bainite to 5 μm or less and hence, the average grain size of bainite is set to 5 μm or less. The average grain size of bainite is more preferably set to 4.0 μm or less.

According to embodiments of the present invention, the steel plate has the above-mentioned features in metal microstructure and hence, lowering of compressive strength caused by a Bauschinger effect can be suppressed whereby the steel plate can acquire high compressive strength. To acquire a larger effect, it is desirable to make a size of MA fine. The smaller an average grain size of MA is, the more the local strain concentration is dispersed and hence, a strain concentration amount is also decreased whereby the generation of a Bauschinger effect can be further suppressed. Accordingly, an average grain size of MA is desirably set to 1 μm or less.

In general, there may be a case where the metal microstructure of a steel plate manufactured by applying accelerated cooling to the steel plate differs in the plate thickness direction. The collapse of a steel pipe which receives external pressure occurs due to a phenomenon that plastic deformation is generated first on an inner surface side of the steel pipe having the smaller circumference. Accordingly, with respect to the compressive strength, the property of the inner surface side of the steel pipe is important and hence, in general, compression test specimens are sampled from the inner surface side of the steel pipe. Accordingly, the above-mentioned metal microstructure defines the microstructure of the inner surface side of the steel pipe, and the microstructure at a position away from a surface of the inner surface side by ¼ of a plate thickness is adopted as the microstructure at a position which represents the collapse performance of the steel pipe.

3. Manufacturing Conditions

According to the present invention, the third embodiment is directed to a manufacturing method where the steel slab containing the above-mentioned chemical composition is heated, is subjected to hot rolling and, thereafter, is subjected to accelerated cooling. Hereinafter, reasons for limiting manufacturing conditions of a steel plate are explained.

Slab Heating Temperature: 950 to 1200° C.

When a slab heating temperature is below 950° C., sufficient strength cannot be acquired, while when the slab heating temperature exceeds 1200° C., fracture toughness and DWTT property are deteriorated. Accordingly, the slab heating temperature is set to a value which falls within a range of 950 to 1200° C. When further excellent DWTT property is required, an upper limit of the slab heating temperature is desirably set to 1100° C.

Rolling Reduction Rate in No-Recrystallization Temperature Range: 60% or More

To acquire the fine bainite microstructure and high base-material fracture toughness in order to decrease a Bauschinger effect, it is preferable to perform sufficient rolling reduction in a no-recrystallization temperature range in a hot rolling step. However, the effect is insufficient when a rolling reduction rate is less than 60% and hence, the rolling reduction rate in the no-recrystallization temperature range is set to 60% or more. The rolling reduction rate in the no-recrystallization temperature range is preferably set to 70% or more. Here, when rolling is performed through a plurality of rolling passes, a cumulative rolling reduction rate is used as the rolling reduction rate. Further, although the no-recrystallization temperature changes depending on an alloy element such as Nb or Ti, with the addition amounts of Nb and Ti according to embodiments of the present invention, an upper-limit temperature of the no-recrystallization temperature range may be set to 950° C.

Rolling Completion Temperature: $Ar_3$ to ($Ar_3$+70° C.)

To suppress lowering of strength caused by a Bauschinger effect, it is preferable to form the metal microstructure into the microstructure which is mainly constituted of bainite and to suppress the formation of soft microstructure such as ferrite. Accordingly, it is preferable to perform hot rolling above an $Ar_3$ temperature which is a ferrite forming temperature. Further, it is preferable to set a rolling completion temperature as low as possible for acquiring the finer bainite structure, while when the rolling completion temperature is excessively high, a grain size of bainite becomes excessively large. Accordingly, an upper limit of the rolling completion temperature is set to ($Ar_3$+70° C.).

The $Ar_3$ temperature changes depending on alloy components of steel and hence, the transformation temperature may be obtained by measurement by carrying out an experiment on respective steels. However, the transformation temperature may be also obtained based on contents using the following formula (1).

$$Ar_3(°\ C.)=910-310C(\%)-80Mn(\%)-20Cu(\%)-15Cr(\%)-55Ni(\%)-80Mo(\%) \quad (1)$$

With respect to the element whose content is at an unavoidable impurity level (element not added), the calculation is made by setting the content of the element to 0%.

Accelerated cooling is performed following hot rolling. Conditions of accelerated cooling are as follows.

Cooling Start Temperature: ($Ar_3$-30° C.) or Above

Although the metal microstructure is formed into the microstructure mainly constituted of bainite by performing accelerated cooling after hot rolling, when a cooling start temperature becomes below an $Ar_3$ temperature which is a ferrite forming temperature, the metal microstructure becomes the mixed microstructure of ferrite and bainite and hence, lowering of strength caused by a Bauschinger effect is large whereby compressive strength is lowered. However, when the accelerated cooling start temperature is ($Ar_3$-30° C.) or above, a fraction of ferrite is low so that lowering of strength caused by a Bauschinger effect is also small. Accordingly, the cooling start temperature is set to ($Ar_3$-30° C.) or above.

Cooling Rate: 10° C./Sec or More

Accelerated cooling is a process indispensable for the acquisition of a steel plate having high strength and high fracture toughness, wherein by cooling the steel plate at a high cooling rate, the steel plate can acquire a strength increasing effect due to transformation strengthening. However, when the cooling rate is less than 10° C./sec, not only the steel plate cannot acquire sufficient strength but also the concentration of C occurs in non-transformed austenite due to the occurrence of diffusion of C and hence, a formation amount of MA becomes large. Since a Bauschinger effect is accelerated due to a hard second phase such as MA as described previously, the cooling rate being less than 10° C./sec results in lowering of compressive strength. However, when the cooling rate is 10° C./sec or more, the diffusion of C during cooling can be decreased so that the formation of MA can be also suppressed. Accordingly, a lower limit of the cooling rate at the time of accelerated cooling is set to 10° C./sec.

Cooling Stop Temperature: More than 300° C. to 550° C.

The bainite transformation progresses by accelerated cooling so that the steel plate can acquire required strength. However, when a temperature at the time of stopping cooling exceeds 550° C., the bainite transformation is insufficient so that the steel plate cannot acquire sufficient tensile strength and compressive strength. Further, the bainite transformation is not completed and hence, the concentration of C occurs in the non-transformed austenite during air cooling after stopping cooling so that the formation of MA is accelerated. On the other hand, when a steel plate average temperature at the time of stopping cooling is 300° C. or below, a temperature of a steel plate surface layer portion is lowered to a martensite transformation temperature or below and hence, an MA fraction of the surface layer portion is increased whereby compressive strength is lowered by a Bauschinger effect. Further, hardness of the surface layer portion is increased and strain is liable to be generated in the steel plate and hence, formability is deteriorated whereby when the steel plate is formed into a pipe, roundness of the pipe is remarkably deteriorated. Accordingly, the temperature at the time of stopping cooling is set to a value which falls within a range of more than 300° C. to 550° C.

According to the present invention, the fourth embodiment is characterized by applying reheating treatment to the steel plate after accelerated cooling. Reasons for limiting the reheating conditions are explained hereinafter.

Steel Plate Surface Temperature: 550 to 720° C.

In accelerated cooling of a steel plate having a heavy wall thickness, a cooling rate is fast in a steel plate surface layer portion, and the surface layer portion is cooled to a temperature lower than a temperature of the inner portion of the steel plate. Accordingly, MA (M-A constituent) is liable to be formed in the steel plate surface layer portion. Such a hard phase accelerates a Bauschinger effect. Lowering of compressive strength caused by a Bauschinger effect can be suppressed by decomposing MA by heating the surface layer portion of the steel plate after accelerated cooling. However, the decomposition of MA is not sufficient when the surface temperature is less than 550° C., while when the surface temperature exceeds 720° C., a heating temperature at a center portion of the steel plate is also elevated thus bringing about large lowering of strength. Accordingly, when reheating is performed aiming at the decomposition of MA after accelerated cooling, the steel plate surface temperature at the time of reheating is set to a value which falls within a range of 550 to 720° C.

Steel Plate Center Temperature: Below 550° C.

Due to reheating after accelerated cooling, MA in the surface layer portion is decomposed so that the steel plate can acquire high compressive strength. However, when a heating temperature of the steel plate center portion becomes 550° C. or above, a phenomenon that cementite coagulates and becomes coarse or the precipitation of a carbide forming element such as Nb, V occurs and hence, DWTT property is deteriorated, and also compressive strength is lowered due to lowering of solid solute C. Accordingly, the steel plate center temperature during reheating after accelerated cooling is set to a temperature below 550° C. As a means for reheating after accelerated cooling, it is desirable to use induction heating which can effectively heat only a surface layer portion where a large amount of MA is present. Further, to acquire an effect brought about by reheating, it is preferable to heat the steel plate to a temperature higher than a temperature at the time of stopping cooling and hence, the steel plate center temperature at the time of reheating is set to a temperature higher than a temperature at the time of stopping cooling by 50° C. or more.

Figure 4:
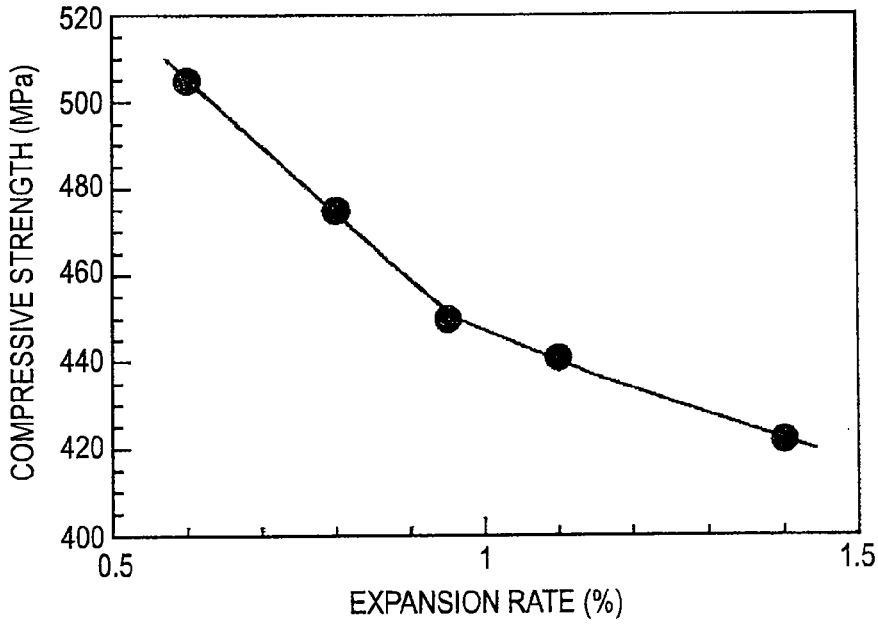
FIG. 4 is a view showing compressive strength when an expansion rate was changed in No. 12 (kind of steel C) in Table 2 and Table 3.
Figure 5:
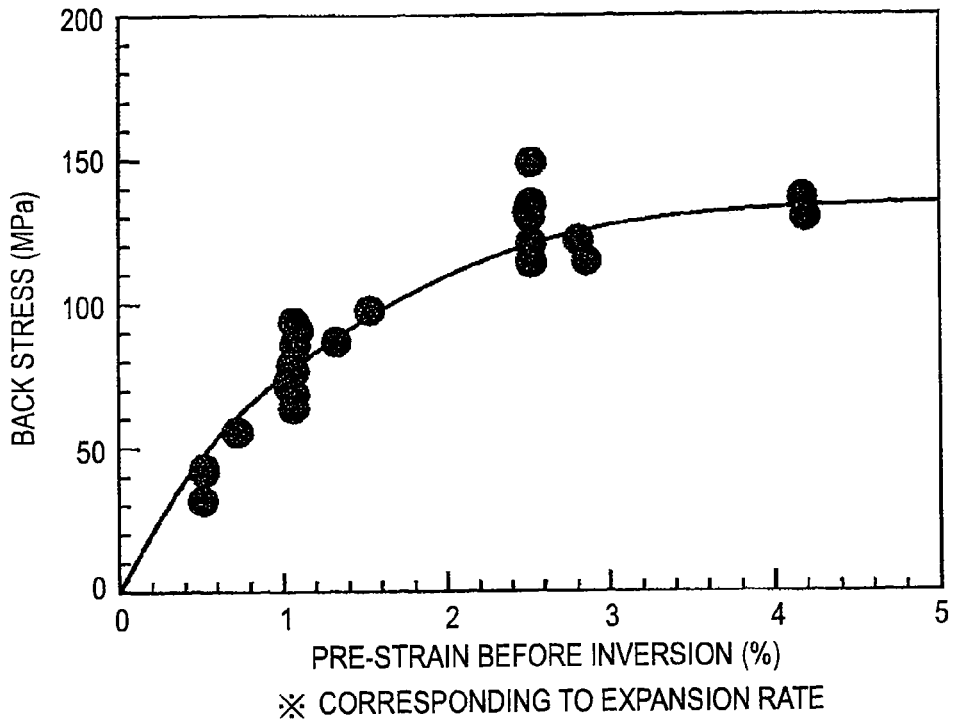
FIG. 5 is a view showing the relationship between prestrain before inversion and back stress corresponding to an expansion rate which is obtained by repeatedly applying a load to a round bar tensile specimen cut out from a steel plate of No. 6 (kind of steel C) in Table 2.

According to embodiments of the present invention, a steel pipe is made using the steel plate manufactured by the above-mentioned method. With respect to a steel pipe forming method, the steel plate is formed into a steel pipe shape by cold forming such as a UOE process or press bend. Thereafter, seam welding is applied to the steel pipe shape. As a welding method used here, any welding method can be adopted provided that sufficient strength of joint and sufficient toughness of joint can be obtained. However, from viewpoints of excellent weld quality and excellent production efficiency, it is preferable to use submerged arc welding. After finishing welding of a butt portions or a seams, the pipe expansion is performed for eliminating weld residual stress and for enhancing roundness of the steel pipe. In this pipe expansion, it is preferable to set an expansion rate to 0.4% or more as a condition for acquiring the steel pipe having predetermined roundness and for eliminating residual stress from the steel pipe. Further, when the expansion rate is excessively high, lowering of compressive strength caused by a Bauschinger effect is serious and hence, an upper limit of the expansion rate is set to 1.2%. Further, in the usual manufacture of a welded steel pipe, in general, an expansion rate is controlled to a value which falls within a range of 0.90 to 1.20% by focusing on securing roundness. On the other hand, from a viewpoint of securing compressive strength, it is desirable that the expansion rate is low. FIG. 4 is a view showing compressive strength when the expansion rate was changed in No. 12 shown in Table 2 and Table 3. As shown in FIG. 4, a remarkable compressive-strength improving effect is observed by setting the expansion rate to 0.9% or less and hence, the expansion rate is more preferably set to a value which falls within a range of 0.4 to 0.9%. The expansion rate is further preferably set to a value which falls within a range of 0.5 to 0.8%. The reason why the remarkable compressive-strength improving effect is observed by setting the expansion rate to 0.9% or less is that, as shown in FIG. 5, in the generation behavior of back stress in a steel material, the back stress is remarkably increased in a low strain region and, thereafter, the degree of increase of the back stress becomes small from approximately 1% and the back stress is saturated at 2.5% or more. FIG. 5 is a view showing the relationship between pre-strain before inversion and back stress, the pre-strain corresponding to an expansion rate which is obtained by repeatedly applying a load to round bar tensile specimens cut out from a steel plate of No. 6 (kind of steel C) in Table 2.

[Embodiment]

Slabs are manufactured from steels (kinds of steels A to K) having chemical compositions shown in Table 1 by a continuous casting process, and heavy-wall-thickness steel plates (No. 1 to 23) having plate thicknesses of 30 mm and 38 mm were manufactured using the slabs. Manufacturing conditions of the steel plates and manufacturing conditions of the steel pipes, metal microstructures, mechanical properties and the like of the steel pipes are respectively shown in Table 2 and Table 3. In reheating treatment at the time of manufacturing the steel plate, reheating was performed using an induction heating furnace which is mounted on the same line as an accelerated cooling facility. A surface layer temperature at the time of reheating is a surface temperature of the steel plate at an exit of the induction heating furnace, and a steel plate temperature at a point of time that a surface layer temperature and a center temperature become substantially equal to each other after heating is set as the center temperature. Using these steel plates, steel pipes having an outer diameter of 762 mm or 900 mm were manufactured by a UOE process.

With respect to tensile property of the steel pipe manufactured as described above, a tensile test was carried out using a whole thickness specimen in the pipe circumferential direction as a tensile specimen, and tensile strength of the tensile specimen was measured. In a compression test, a specimen having a diameter of 20 mm and a length of 60 mm was sampled from the steel pipe in the pipe circumferential direction at a position on an inner surface side of the steel pipe, and the compression test was carried out so as to measure compressive yield strength (or 0.5% proof strength). Further, using a DWTT specimen sampled from the steel pipe in the pipe circumferential direction, a temperature at which a shear area becomes 85% was determined as 85% SATT. HIC resistance was obtained by carrying out an HIC test using a 5% NaCl+0.5% $CH_3COOH$ aqueous solution in which hydrogen sulfide ($H_2S$) with pH of approximately 3 is saturated (usual NACE (National Association of Corrosion Engineers) solution). After immersing the specimen in the aqueous solution for 96 hours, the presence or the non-presence of cracks on the whole surface of the specimen was investigated by ultrasonic inspection, and the HIC resistance was evaluated based on a crack area ratio (CAR). Here, three specimens were sampled from respective steel plates, and these specimens were subjected to HIC test. A maximum value among individual crack area ratios was adopted as the crack area ratio representing the steel plate. With respect to the metal microstructure, a sample was sampled from a position of ¼ of a plate thickness on an inner surface side of the steel pipe, the sample was etched using nital after polishing, and the metal microstructure was observed using an optical microscope. Then, using three to five photographs taken at magnification of 200 times, a fraction of bainite was obtained by an image analysis. An average grain size of bainite was obtained by a line analysis using the same microscopic photographs. In the observation of MA, after etching the specimen using nital, electrolytic etching (two-step etching) was applied to the specimen and, thereafter, the microstructure was observed using a scanning electron microscope (SEM). Then, using photographs taken at magnification of 1000 times, an area fraction and an average grain size of MA were obtained by an image analysis. Here, the average grain size of MA was determined as a circle equivalent diameter by an image analysis.

As shown in Table 2 and Table 3, in all of No. 1 to 10 which are examples of the present invention, the chemical compositions, the manufacturing methods and the microstructures were within the scope of the present invention. Also No. 1 to 10 exhibited high compressive strength of 430 MPa or more and also exhibited favorable DWTT property and favorable HIC resistance.

On the other hand, in No. 11 to 18, although the chemical compositions were within the scope of the present invention, the manufacturing methods were outside the scope of the present invention and hence, No. 11 to 18 are inferior to the present invention example with respect to any one of compressive strength, DWTT property and HIC resistance. In No. 19 to 23, the chemical compositions fall outside the scope of the present invention and hence, No. 19 to 23 were inferior to the present invention examples with respect to HIC resistance or short in compressive strength.

According to the present invention, it is possible to acquire a steel pipe having a heavy wall thickness which has high compressive strength and also has excellent DWTT property and HIC resistance and hence, the steel pipe is applicable to a linepipe for deep-sea which is required to exhibit high collapse resistant performance and, particularly to a linepipe for transporting a sour gas.

TABLE 1

| Kind of | Chemical composition (mass %) | | | | | | | | | | | |
|---|---|---|---|---|---|---|---|---|---|---|---|---|
| steel | C | Si | Mn | P | S | Al | Nb | Ti | Mo | Ni | Cr | Cu |
| A | 0.056 | 0.31 | 1.44 | 0.005 | 0.0004 | 0.032 | 0.045 | 0.012 | — | — | — | — |
| B | 0.036 | 0.18 | 1.32 | 0.003 | 0.0006 | 0.038 | 0.032 | 0.009 | 0.18 | 0.22 | — | — |
| C | 0.037 | 0.30 | 1.18 | 0.006 | 0.0006 | 0.033 | 0.030 | 0.009 | 0.12 | 0.28 | 0.24 | — |
| D | 0.041 | 0.25 | 1.26 | 0.005 | 0.0007 | 0.035 | 0.028 | 0.013 | — | 0.45 | — | 0.28 |
| E | 0.043 | 0.27 | 1.20 | 0.009 | 0.0005 | 0.028 | 0.026 | 0.010 | 0.07 | — | 0.15 | — |
| F | 0.052 | 0.15 | 1.24 | 0.003 | 0.0005 | 0.031 | 0.025 | 0.011 | 0.12 | 0.28 | 0.18 | — |
| G | 0.064 | 0.21 | 1.22 | 0.004 | 0.0006 | 0.030 | 0.025 | 0.012 | 0.13 | 0.22 | — | 0.23 |
| H | 0.040 | 0.18 | 1.16 | 0.013 | 0.0006 | 0.025 | 0.018 | 0.009 | 0.15 | — | 0.14 | — |

TABLE 1-continued

| | | | | | | | | | | | | |
|---|---|---|---|---|---|---|---|---|---|---|---|---|
| I | 0.037 | 0.22 | 1.25 | 0.005 | 0.0007 | 0.033 | 0.048 | 0.010 | 0.29 | — | — | — |
| J | 0.045 | 0.15 | 1.12 | 0.004 | 0.0005 | 0.033 | 0.021 | 0.012 | 0.08 | — | — | — |
| K | 0.042 | 0.25 | 1.28 | 0.005 | 0.0003 | 0.042 | 0.032 | 0.016 | 0.20 | 0.12 | — | — |

| Kind of steel | Chemical composition (mass %) V | Ca | N | Ti/N | C* | Ceq | CP | $Ar_3$ (° C.) | Remarks |
|---|---|---|---|---|---|---|---|---|---|
| A | — | 0.0018 | 0.0036 | 3.33 | 0.053 | 0.03 | 0.93 | 777 | Present |
| B | — | 0.0022 | 0.0033 | 2.73 | 0.029 | 0.31 | 0.84 | 767 | invention |
| C | 0.042 | 0.0031 | 0.0048 | 1.88 | 0.030 | 0.33 | 0.92 | 776 | example |
| D | 0.045 | 0.0020 | 0.0038 | 3.42 | 0.037 | 0.31 | 0.89 | 766 | |
| E | 0.035 | 0.0024 | 0.0036 | 2.78 | 0.038 | 0.29 | 0.94 | 793 | |
| F | — | 0.0016 | 0.0043 | 2.56 | 0.047 | 0.34 | 0.91 | 767 | |
| G | 0.024 | 0.0018 | 0.0035 | 3.43 | 0.058 | 0.33 | 0.97 | 765 | Comparison |
| H | 0.032 | 0.0025 | 0.0033 | 2.73 | 0.033 | 0.30 | 1.03 | 791 | example |
| I | 0.065 | 0.0023 | 0.0045 | 2.22 | 0.023 | 0.32 | 0.91 | 775 | |
| J | 0.033 | — | 0.0033 | 3.64 | 0.040 | 0.25 | 0.78 | 800 | |
| K | — | 0.0025 | 0.0036 | 4.44 | 0.035 | 0.30 | 0.90 | 772 | |

Underlined parts indicate values outside the scope of the present invention

C* = C − 0.065Nb − 0.025Mo − 0.057V (respective element symbols indicate contents (mass %))

Ceq = C + Mn/6 + (Cu + Ni)/15 + (Cr + Mo + V)/5 (respective element symbols indicate contents (mass %))

CP = 4.46C + 2.37Mn/6 + (1.18Cr + 1.95Mo + 1.74V)/5 + (1.74Cu + 1.7Ni)/15 + 22.36P (respective element symbols indicate contents (mass %))

TABLE 2

| | | Steel pipe size | | Steel plate manufacturing condition | | | | | | | | | |
|---|---|---|---|---|---|---|---|---|---|---|---|---|---|
| No. | Kind of steel | Outer diameter (mm) | Wall thickness (mm) | Slab heating temperature (° C.) | Rolling reduction in no-recrystallization temperature range (%) | Rolling completion temperature (° C.) | Rolling completion temperature − $Ar_3$ (° C.) | Accelerated cooling start temperature (° C.) | Accelerated cooling start temperature − $Ar_3$ (° C.) | Accelerated cooling stop temperature (° C.) | Cooling rate (° C./sec) | Reheating temperature (° C.) Surface layer | Reheating temperature (° C.) Center |
| 1 | A | 762 | 30 | 1120 | 80 | 790 | 13 | 770 | −7 | 420 | 23 | 605 | 445 |
| 2 | B | 762 | 30 | 1080 | 75 | 800 | 33 | 790 | 23 | 450 | 21 | 580 | 435 |
| 3 | C | 900 | 38 | 1070 | 75 | 800 | 24 | 792 | 16 | 350 | 16 | 640 | 455 |
| 4 | C | 900 | 38 | 1070 | 75 | 776 | 0 | 760 | −16 | 365 | 17 | 600 | 425 |
| 5 | C | 762 | 30 | 1120 | 75 | 820 | 44 | 803 | 27 | 320 | 25 | — | — |
| 6 | C | 900 | 38 | 1060 | 75 | 800 | 24 | 790 | 14 | 350 | 17 | 610 | 450 |
| 7 | C | 900 | 38 | 1060 | 75 | 800 | 24 | 790 | 14 | 350 | 17 | 610 | 450 |
| 8 | D | 762 | 30 | 1100 | 75 | 790 | 24 | 770 | 4 | 405 | 22 | 630 | 475 |
| 9 | E | 762 | 30 | 1100 | 75 | 845 | 52 | 810 | 17 | 380 | 23 | 575 | 420 |
| 10 | F | 762 | 30 | 1100 | 65 | 790 | 23 | 770 | 3 | 405 | 24 | 630 | 475 |
| 11 | C | 900 | 38 | 1060 | 75 | 800 | 24 | 790 | 14 | 330 | 18 | — | — |
| 12 | C | 900 | 38 | 1060 | 75 | 762 | −14 | 742 | −34 | 345 | 17 | — | — |
| 13 | C | 900 | 38 | 1060 | 75 | 800 | 24 | 790 | 14 | 405 | 5 | 540 | 385 |
| 14 | C | 900 | 38 | 1060 | 75 | 800 | 24 | 790 | 14 | 350 | 17 | 610 | 450 |
| 15 | D | 762 | 30 | 1100 | 50 | 805 | 39 | 784 | 18 | 380 | 22 | 630 | 480 |
| 16 | D | 762 | 30 | 1100 | 75 | 842 | 76 | 793 | 27 | 420 | 24 | 610 | 450 |
| 17 | D | 762 | 30 | 1100 | 75 | 785 | 19 | 760 | −6 | 580 | 23 | 645 | 490 |
| 18 | D | 762 | 30 | 1100 | 75 | 790 | 24 | 770 | 4 | 250 | 24 | 630 | 475 |
| 19 | G | 762 | 30 | 1100 | 75 | 800 | 35 | 770 | 5 | 420 | 22 | 650 | 495 |
| 20 | H | 762 | 30 | 1100 | 75 | 820 | 29 | 785 | −6 | 415 | 23 | 640 | 480 |
| 21 | I | 762 | 30 | 1100 | 75 | 810 | 35 | 780 | 5 | 450 | 22 | 640 | 485 |
| 22 | J | 762 | 30 | 1100 | 75 | 840 | 40 | 815 | 15 | 435 | 24 | 635 | 470 |
| 23 | K | 762 | 30 | 1100 | 75 | 795 | 23 | 770 | −2 | 450 | 24 | 620 | 430 |

Underlined parts indicate values outside the scope of the present invention

TABLE 3

| | Steel pipe | Metal microstructure | | | | Mechanical property of steel pipe | | | | |
|---|---|---|---|---|---|---|---|---|---|---|
| No. | manufacturing condition Expansion rate (%) | Bainite fraction (%) | Average grain size of bainite (μm) | MA fraction (%) | Average grain size of MA (μm) | Tensile strength (MPa) | Compressive yield strength (MPa) | Drop Weight Tear Test property 85% SATT (° C.) | Hydrogen Induced Cracking resistance CAR (%) | Remarks |
| 1 | 0.8 | 86 | 3.4 | 1.2 | 0.8 | 565 | 452 | −45 | 4.1 | Present |
| 2 | 1.0 | 91 | 4.1 | 0.7 | 0.5 | 573 | 463 | −35 | 2.1 | invention |
| 3 | 0.8 | 98 | 3.8 | 0.6 | 0.7 | 572 | 475 | −35 | 1.8 | example |

TABLE 3-continued

| No. | Steel pipe manufacturing condition Expansion rate (%) | Metal microstructure Bainite fraction (%) | Average grain size of bainite (μm) | MA fraction (%) | Average grain size of MA (μm) | Mechanical property of steel pipe Tensile strength (MPa) | Compressive yield strength (MPa) | Drop Weight Tear Test property 85% SATT (° C.) | Hydrogen Induced Cracking resistance CAR (%) | Remarks |
|---|---|---|---|---|---|---|---|---|---|---|
| 4 | 1.1 | 85 | 3.3 | 1.4 | 0.5 | 562 | 441 | −42 | 3.6 | |
| 5 | 0.6 | 97 | 4.2 | 1.6 | 0.6 | 598 | 467 | −35 | 0 | |
| 6 | 0.6 | 97 | 3.6 | 1.2 | 0.8 | 575 | 505 | −36 | 0 | |
| 7 | 0.95 | 97 | 3.6 | 1.2 | 0.8 | 580 | 450 | −33 | 0 | |
| 8 | 0.8 | 95 | 3.8 | 0.8 | 0.5 | 561 | 478 | −38 | 0 | |
| 9 | 0.9 | 98 | 4.1 | 1.5 | 0.9 | 584 | 488 | −33 | 3.8 | |
| 10 | 0.8 | 94 | 3.8 | 1.2 | 0.7 | 593 | 502 | −28 | 0 | |
| 11 | 1.0 | 95 | 4.1 | 3.2 | 1.8 | 586 | 428 | −38 | 2.2 | Comparison example |
| 12 | 1.0 | 52 | 4.6 | 2.6 | 1.5 | 542 | 406 | −42 | 24.6 | |
| 13 | 0.8 | 94 | 5.8 | 3.8 | 2.1 | 531 | 397 | −22 | 1.8 | |
| 14 | 1.4 | 97 | 3.6 | 1.2 | 0.8 | 583 | 422 | −35 | 0 | |
| 15 | 0.8 | 95 | 6.8 | 1.4 | 2.3 | 574 | 425 | −18 | 0 | |
| 16 | 0.8 | 97 | 7.2 | 1.2 | 2.2 | 595 | 430 | −8 | 0 | |
| 17 | 0.8 | 93 | 4.6 | 5.2 | 1.8 | 497 | 386 | −20 | 12.6 | |
| 18 | 1.0 | 92 | 3.5 | 3.1 | 0.7 | 573 | 422 | −38 | 0 | |
| 19 | 0.9 | 92 | 4.0 | 1.2 | 1.0 | 597 | 469 | −35 | 24.5 | |
| 20 | 0.8 | 92 | 3.8 | 0.8 | 0.6 | 565 | 455 | −22 | 31.6 | |
| 21 | 0.8 | 95 | 4.2 | 1.2 | 1.0 | 579 | 420 | −35 | 0 | |
| 22 | 0.9 | 96 | 4.6 | 0.6 | 0.8 | 510 | 385 | −45 | 0 | |
| 23 | 1.0 | 85 | 4.2 | 1.8 | 1.2 | 570 | 432 | −35 | 0 | |

Underlined parts indicate values outside the scope of the present invention

The invention claimed is:

1. A welded steel pipe for a linepipe having the composition which contains by mass % 0.02 to 0.06% C, 0.01 to 0.5% Si, 0.8 to 1.6% Mn, 0.012% or less P, 0.0008% or less S, 0.01 to 0.08% Al, 0.005 to 0.050% Nb, 0.005 to 0.025% Ti, 0.0005 to 0.0035% Ca, 0.0020 to 0.0060% N, and Fe and unavoidable impurities as a balance, wherein C(%)−0.065Nb(%) is 0.025 or more, a CP value is 0.95 or less, a Ceq value is 0.28 or more, Ti/N is a value which falls within a range of 1.5 to 4.0, and the steel pipe has metal microstructure where a fraction of bainite is 80% or more, a fraction of martensite-austenite constituent (MA) is 2% or less, and an average grain size of bainite is 5 μm or less, wherein the CP value is expressed by the formula:

$$CP=4.46C(\%)+2.37Mn(\%)/6+\{1.18Cr(\%)+1.95Mo(\%)+1.74V(\%)\}/5+\{1.74Cu(\%)+1.7Ni(\%)\}/15+22.36P(\%);\text{ and}$$

wherein the Ceq value is expressed by the formula:

$$Ceq=C(\%)+Mn(\%)/6+\{Cr(\%)+Mo(\%)+V(\%)\}/5+\{Cu(\%)+Ni(\%)\}/15.$$

2. The welded steel pipe for a linepipe according to claim 1, wherein the composition further contains by mass % one or two kinds or more selected from a group consisting of 0.5% or less Cu, 1.0% or less Ni, 0.5% or less Cr, 0.5% or less Mo, and 0.1% or less V, and C(%)−0.065Nb(%)−0.025Mo(%)−0.057V(%) is 0.025 or more.

3. A method of manufacturing a welded steel pipe for a linepipe, wherein steel having the composition described in claim 1 is heated to a temperature which falls within a range of 950 to 1200° C., is subjected to hot rolling where a rolling reduction rate in a no-recrystallization temperature range is set to 60% or more and a rolling completion temperature falls within a range of $Ar_3$ to ($Ar_3$+70° C.), and subsequently, is subjected to accelerated cooling at a cooling rate of 10° C./sec or more from a temperature of ($Ar_3$−30° C.) or more to a temperature which falls within a range of 300° C. or above to 550° C. thus a steel plate being manufactured, the steel plate is formed into a steel pipe shape by cold forming, seam welding is applied to a butt portion of the steel pipe shape to form a steel pipe, and the steel pipe is subjected to pipe expansion with an expansion rate of 0.4 to 1.2%.

4. The method of manufacturing a welded steel pipe for a linepipe according to claim 3, wherein the steel plate is subjected to reheating following the accelerated cooling such that a steel plate surface temperature falls within a range of 550 to 720° C., and a steel plate center temperature becomes below 550° C.

* * * * *